United States Patent [19]

Westberg

[11] 3,945,079

[45] Mar. 23, 1976

[54] LAMINATED PHOTOGRAPHIC FILM CLEANING FABRIC

[75] Inventor: Walter M. Westberg, Troy Township, Saint Croix County, Wis.

[73] Assignee: Minnesota Mining and Manufacturing Company, St. Paul, Minn.

[22] Filed: Mar. 31, 1975

[21] Appl. No.: 563,388

[52] U.S. Cl. ..... 15/100; 15/102; 352/130; 428/293; 428/302

[51] Int. Cl.[2] ..... B08B 11/00

[58] Field of Search ..... 15/100, 102; 428/280, 293, 428/298, 302; 34/154, 153, 152; 352/130

[56] References Cited

UNITED STATES PATENTS 3,644,953 2/1972 Christiansen ..... 15/100

*Primary Examiner*—Edward L. Roberts
*Attorney, Agent, or Firm*—Alexander, Sell, Steldt & DeLaHunt

[57] ABSTRACT

A cleaning fabric having a contact surface against which the surface of a photographic film can be rubbed to remove foreign particles from the film. The fabric is a laminate comprising a non-woven wiping layer of soft fine intersecting bonded fibers defining the contact surface. The fibers in the wiping layer are randomly spaced and disposed to provide openings in the wiping layer for receiving foreign particles, and the wiping layer is compacted in a direction normal to the contact surface so that few ends or loops of the fibers project past the wiping surface, thereby restricting shearing or tearing loose of the fibers by the edges of a passing photographic film. An open non-woven lofty backing layer is adhered to the surface of the wiping layer opposite the contact surface. The backing layer is formed of stiff resilient randomly spaced and disposed bonded fibers and is sufficiently thick so that the backing layer can be supported in a slightly compressed condition to evenly press the contact surface into intimate engagement with a photographic film and to maintain such contact by slight expansion or further compression to compensate for irregularities in the film.

10 Claims, 3 Drawing Figures

LAMINATED PHOTOGRAPHIC FILM CLEANING FABRIC

BACKGROUND OF THE INVENTION

1. Field of the Invention

The present invention relates to fabrics against which a surface may be wiped to remove foreign particles, and in one aspect to such a cleaning fabric particularly adapted for the removal of foreign particles from photographic film.

2. Description of the Prior Art

U.S. Pat. No. 3,644,953 describes a device with which foreign particles can be removed from photographic film by passing the film between two lengths of cleaning fabric biased for intimate contact with the photographic film. An embodiment of this device is illustrated in FIG. 1 of the drawing. The device 10 illustrated therein includes a pair of support members or rollers 12 and 14 providing narrow support edges adapted for bringing narrow sections of two lengths 16 and 18 of cleaning fabric into intimate contact with the surfaces of a photographic film 20 passed therebetween. The support members 12 and 14 are spaced to afford slight compression of the lengths of cleaning fabric 16 and 18 as the photographic film 20 passes therebetween so that the support members 12 and 14 will provide intimate and complete contact between the lengths of cleaning fabric 16 and 18 and the photographic film 20.

After the photographic film 20 is cleaned by movement between the lengths of cleaning fabric 16 and 18, it passes adjacent a nuclear source of alpha particles 22 which neutralize charges on the cleaned film to restrict its attraction to dust particles in the air.

A mechanism is provided for changing the sections of the lengths of cleaning fabric 16 and 18 in the nip between the support members 12 and 14. This mechanism comprises a series of gears 24, 26, 28, 30, 32 and 34, driven by a motor 36 to wind the lengths of cleaning fabric 16 and 18 onto takeup spools 38 and off of supply spools 40.

Prior to the present invention the cleaning fabric used in the apparatus 10 for the accumulation of dust was a non-woven cloth of soft fine denier fibers bonded together at the fiber cross-over points by a resin binder. An example of such a cloth is that sold by the Pellon Corporation, Lowell, Mass., under the trade designation Grade 301W spun bonded polyamide web.

A cleaning fabric of this type can provide adequate cleaning for photographic film. However, the selection of the type or mixture of fibers used in cleaning fabrics of this type and of the method of bonding the fibers together requires a compromise between selecting fibers and a bonding system which provide a desirable resiliency in the cleaning fabric so that in use the fabric can be slightly compressed to insure even intimate contact by the cleaning fabric across the entire width of the photographic film while allowing the fabric to expand or be further compressed to compensate for irregularities in the film; and selecting fibers and a bonding system which provide a contact surface for the cleaning fabric which has few projecting fiber ends or fiber loops. Such projecting ends and loops, if they are present, tend to be cut or pulled from the lengths of cleaning fabric by the passage of a photographic film therebetween (i.e. as by the leading edge of a film, sprocket holes in the film, or a splice in the film), thereby providing a loose fiber which may become disposed on the surface of the photographic film. Such loose fibers can cause a serious blemish on a print of the film, and sometimes are left at the gate in automatic printing devices and cause blemishes on a series of subsequently produced prints.

SUMMARY OF THE INVENTION

The present invention provides an improved cleaning fabric for use in a device such as that illustrated in FIG. 1, which cleaning fabric has both a contact surface defined by soft fibers providing openings for receiving foreign particles while having few ends or loops projecting past the cleaning surface to greatly reduce the probability of fibers being removed from the cleaning fabric by passing photographic film; and has a high degree of resiliency so that it can be supported in a slightly compressed condition to evenly press the contact surface into intimate engagement with a photographic film, and to maintain such contact by expanding or compressing slightly to compensate for irregularities in the film being cleaned.

The cleaning fabric according to the present invention is a laminate including a non-woven wiping layer of intersecting bonded fibers defining the contact surface. The fibers in the wiping layer are randomly oriented and spaced to provide openings for receiving foreign particles from a photographic film rubbed across the contact surface. Also the wiping layer is compacted in a direction normal to the contact surface so that few ends or loops of the fibers project past the wiping surface to restrict snagging and removal of fibers from the wiping layer by the photographic film being cleaned. The cleaning fabric also includes an open non-woven lofty relatively thick backing layer adhered to the surface of the wiping layer opposite the contact surface comprising stiff resilient randomly spaced and disposed bonded fibers providing a predetermined desired resilience for the wiping cloth.

The wiping layer is constructed of fine fibers, preferably in the range of about 1½ to 3 denier, which fine fibers afford complete intimate contact with the surface of a photographic film. The fibers are sufficiently soft that they will not mar the photographic film.

To facilitate manufacture of the cleaning fabric, the fibers for the wiping layer are preferably hydrophilic (e.g. can absorb at least about 25% of their weight in water when exposed to 95% relative humidity at room temperature) so that when wetted, the fibers become extremely limp. Such hydrophilic fibers when loosely and randomly disposed in a layer can be made very limp, compacted together in a direction normal to the surface of the layer, and adhered together in that position by the addition of a water base binder to the layer. This is the preferred method for producing the wiping layer described above, however heating and pressing an open non-woven layer of fabric comprising resilient fibers bonded with a thermoplastic resin followed by cooling the fabric with the fibers held in the pressed position may also be a suitable method for producing such a wiping layer. The preferred fiber for use in forming the wiping layer by this preferred method is standard rayon having a stiffness value of 6 to 11 grams and a water absorption of about 27 at 95% relative humidity. High modulus rayon having a stiffness value of 28 grams and about the same water absorption may also be used, however there is no requirement for the added stiffness of this fiber in the wiping layer.

The backing layer should be formed of resilient fibers which are sufficiently thick and stiff that, when the cleaning fabric is supported in a partially compressed condition against a photographic film, the fibers will provide sufficient force to insure complete intimate contact between the fibers on the contact surface and the film. Also the backing layer should be sufficiently thick that, when thus compressed against a film, it can expand or be further resiliently compressed to accommodate slight irregularities in a film being cleaned.

Preferably the fibers forming the backing layer should be 3 denier or over to insure sufficient spring force in the fibers, but should not be of such large denier that the open surface of the backing layer will not provide adequate support for the wiping layer. There should be no need to use fibers in the backing layer of over 10 denier.

The following method has been developed to measure the uncompressed thickness and compressibility of the laminated cleaning fabric, and is the method used for determining any uncompressed thickness or compressibility values recited in the claims of this application. A foot having a circular flat surface 2.54 centimeters (1 inch) in diameter is positioned with the flat surface on the fabric or layer, which in turn is supported on a planar surface. The foot is loaded to a total of 100 grams and the thickness of the fabric or layer is measured. This is deemed a measurement of the uncompressed thickness of the cleaning fabric or layer, since the loading provided by the foot is only sufficient to clearly define the surfaces of the fabric or layer and will not significantly compress it. Subsequently, a 464 grams load is added to the foot (e.g. an increased loading of about 183 grams per square centimeter). The thickness of the fabric or layer is again measured, and the difference measured as the compressibility of the cleaning fabric.

As measured by this test, the uncompressed thickness of the cleaning fabric should be in the range of 0.2 to 0.5 millimeter (8 to 20 mils), and upon adding the 464 gram loading to the foot, the cleaning fabric should be compressed by at least 0.05 millimeter (2 mils) for cleaning fabric having an uncompressed thickness of 0.2 millimeter (8 mils), and should be compressed in the range of 0.05 to 0.18 millimeter (2 to 7 mils) for cleaning fabric having an uncompressed thickness of 0.5 millimeter (20 mils).

Nylon or polyester are preferred materials for use in the backing, since these fibers are hydrophobic and thus will not lose their loft when bonded by a method similar to that previously described as being preferred for forming the wiping web (e.g. randomly and loosely disposing the fibers to be bonded in a layer, and then adhering them together by adding a water base binder). Being hydrophobic, however, these fibers do not mat together and form a web having sufficient tensile strength to afford easy handling of the web upon the addition of water base binder. Thus to provide such wet strength and facilitate use of this method, as much as 50% of a stiff resilient hydrophilic fiber such as high modulus rayon can be added to the backing material without causing the backing layer to be excessively compacted by this layer forming method.

The binder which bonds the intersecting non-woven fibers to each other in each layer and, which laminates the wiping layer and backing layer together must have sufficient toughness that it will not flake from the cleaning cloth, and should not scratch photographic film. Also it should be present in sufficient quantity to insure that individual fibers cannot be easily abraded from the cleaning fabric, but should not be present in such a quantity that it will significantly increase the stiffness of the cleaning fabric or fill the openings in the layers.

Preferred are water base latex binders such as the acrylic binders designated Rhoplex HA-8 and Rhoplex E-32, both sold by Rohm and Haas Company.

As an example, when these binders are used to bind the fibers and layers in a cleaning fabric having a fiber weight of 8 pounds per ream of 3 denier rayon in the wiping layer, and 5 pounds per ream of 3 denier polyester and 5 pounds per ream of 3 denier high modulus rayon in the backing layer, the dried binder should comprise over about 25% of the total fabric weight to insure that fibers will not be easily dislodged from the cleaning fabric (i.e. as used herein, weight per ream refers to a 320 square yard ream). With these fibers, there should be no need to use a quantity of binder which when dried comprises over 40% of the fabric weight, however, as such an amount will provide no improvement of the adhesion of the fibers and will tend to fill the interstices therebetween.

BRIEF DESCRIPTION OF THE DRAWING

The present invention will be further described with reference to the accompanying drawing wherein like numbers refer to like parts in the several views, and wherein.

DESCRIPTION OF THE PREFERRED EMBODIMENT

Figure 2:
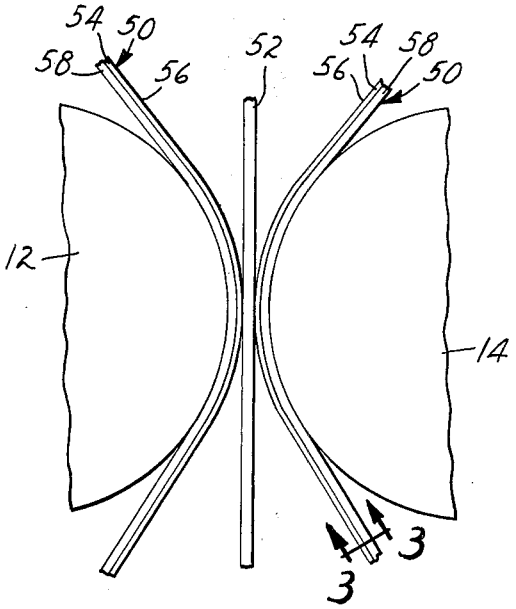
FIG. 2 is an enlarged fragmentary view illustrating the use of the cleaning fabric according to the present invention in the prior art device illustrated in FIG. 1.

Referring now to FIG. 2, there is illustrated two lengths of cleaning fabric according to the present invention, each generally designated by the reference numeral 50. The two lengths of cleaning fabric 50 are shown with opposed portions thereof positioned between the support members 12 and 14 of the device 10, and positioned thereby for intimate contact with a photographic film 52 passing therebetween.

Figure 3:
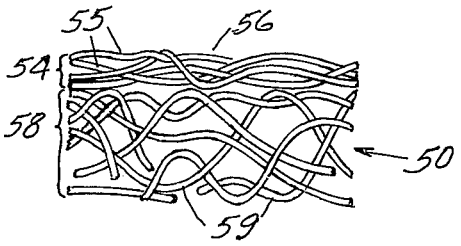
FIG. 3 is a much enlarged fragmentary view of the cleaning fabric according to the present invention taken approximately along the lines 3—3 of FIG. 2 and rotated 90 degrees clockwise.

As is best seen in FIG. 3, each length of cleaning fabric 50 is a laminate including a non-woven wiping layer 54 of randomly spaced and disposed intersecting fibers 55 bonded together at their fiber cross-over points. The fibers 55 define a contact surface 56 having openings for receiving foreign particles. The wiping layer 54 is compacted in a direction normal to the contact surface 56 so that few ends or loops of the fibers 55 project above the contact surface 56 where they might otherwise be snagged by the photographic film 52.

Also, the lengths of cleaning fabric 50 each include an open non-woven lofty relatively thick backing layer 58 comprising stiff resilient randomly spaced and disposed fibers 59 bonded together at their fiber cross-over points. The resilient backing layer 58 is bonded or laminated to the surface of the wiping layer 54 opposite the contact surface 56. The backing layers 58 are slightly compressed by a photographic film 52 between the support members 12 and 14 and provide means for biasing the fibers 55 on the contact surfaces 56 of the lengths of cleaning fabric 50 into even intimate engagement with the surfaces of the photographic film 52 therebetween (FIG. 2) axially along the support members 12 and 14 and for maintaining such contact by expanding or being further compressed slightly to compensate for irregularities in the film (e.g. to allow passage of a splice in the film).

EXAMPLE I

A cleaning fabric according to the present invention was prepared on a device comprising a resin applying station adapted for applying water base binder via the use of padding rolls to loose non-woven randomly spaced and disposed fibers fed to the resin applying station from a carding machine such as a garnett or random web device such as a Rando Webber supplied by the Curlator Corporation; and an oven for drying the wetted mat of fibers conveyed from the applying station. The wiping layer was prepared on the device by bonding together 8 pounds per ream of 3 denier rayon fiber in accordance with the aforementioned preferred method, including the addition of a sufficient quantity of Rhoplex HA-8 acrylic latex binder to provide a dried wiping web weighing 10 pounds per ream.

A backing layer was separately prepared on the device by bonding together a thoroughly blended mixture of fibers consisting of 5 pounds per ream of 3 denier polyester fibers and 5 pounds per ream of 3 denier high modulus rayon in accordance with the aforementioned method of preparing the backing layer, including the addition of a sufficient quantity of Rhoplex HA-8 to provide a dried backing layer weighing 12.5 pounds per ream.

The dried wiping and backing layers were placed with their surfaces in contact, and laminated together in the resin applying station of the device via the addition of a sufficient quantity of Rhoplex E-32 acrylic latex binder to provide a laminated structure, which when dried was a cleaning fabric according to the present invention weighing a total of 26 pounds per ream, and having a resin content by weight of 31%.

The cleaning efficiency of the cleaning fabric was then tested by the following test procedure. The surface of a photographic negative was contaminated with 30 micron diameter ceramic beads or particles. This particular size was selected because particles of 30 micron and larger must be removed from a negative to be printed to insure a commercially acceptable print when the photographic negative is enlarged 4.5 times (e.g. a 126 negative which is 28 by 28 millimeter in size is enlarged to 127 by 127 millimeter in size (5 × 5 inches)). The particles are distributed on the negative with a device comprising a 46 centimeter long hollow cylindrical tube with an inside diameter of about 5 centimeters, an open end, and an opposite closed end to which is centrally coupled an S-shaped length of 0.8 centimeter (5/16 inch) copper tubing which terminates at a rubber squeeze bulb. An operator places the open end of the tube over the negative, inserts a small quantity of the ceramic beads or particles into the S-shaped tube through an opening adjacent the squeeze bulb, places his finger over the opening, and squeezes the bulb to blow the particles into the cylindrical tube when they then settle and are distributed evenly on the surface of the negative. The amount of particles used is selected to provide a concentration on the negative of about 100 to 200 particle per square centimeter. The contaminated negative is then placed at the projection plane of a microfilm reader-printer (such as the Model 400 reader-printer sold by Minnesota Mining and Manufacturing Company) which provides a magnification of 23.3X. The reader-printer is modified by removing the supporting glass plates from the film holder at its exposure station and adapting the printer to hold the contaminated film at its edges so as to restrict transfer of the particles from the negative. The reader-printer is activated to print a magnified picture of the negative.

Figure 1:
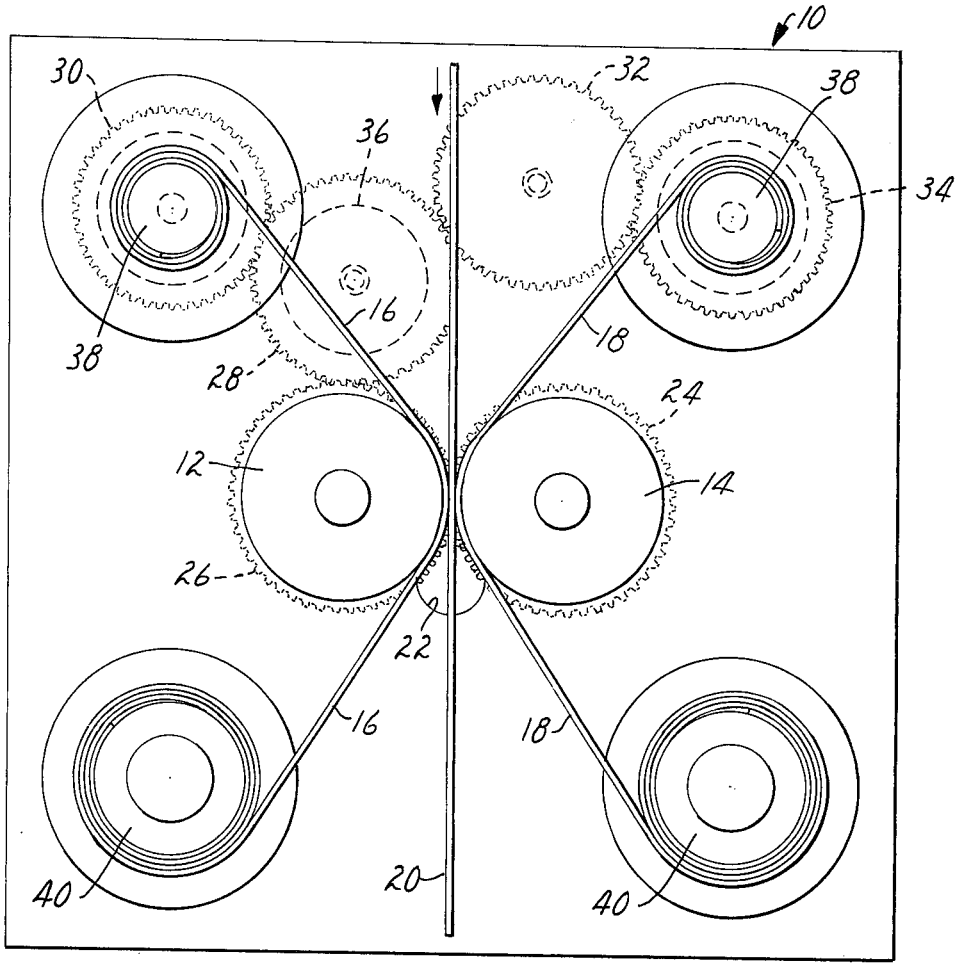
FIG. 1 is a plan view of a prior art device which utilizes two lengths of cleaning fabric to clean a photographic film passed therebetween.

The contaminated negative is then cleaned in a Model 520 photographic film cleaning machine, sold by Minnesota Mining and Manufacturing Company of St. Paul, Minn., which cleaning machine has essentially the same structure illustrated in FIG. 1, but in which are substituted lengths of the cleaning fabric to be tested. The contaminated negative is run through the cleaning machine which has its support members spaced so that the contaminated negative will require a tension of about 12 grams per centimeter of negative width contacting the cleaning fabric to produce a slow steady movement of the film through the cleaning machine.

The cleaned film is again placed in the modified microfilm reader-printer, a print is made, and the result recorded by counting the particles remaining on the magnified portion of the negative.

Repeated tests of this type showed an average of about 0.7 particles per square centimeter remained on the cleaned film.

A test was also performed to determine the tendency of the cleaning fabric to release fibers which would project above its contact surface. A test machine was prepared which had a generally cylindrical mandrel 11 millimeters in diameter and having axially extending opposite slots in its periphery 3 millimeters wide and 1.5 millimeters deep. The mandrel was rotated at 1725 r.p.m. A test length of the cleaning fabric about 5 centimeters wide and 13 centimeters long was prepared. The test length was looped over the rotating mandrel with its contact surface adjacent thereto, its ends were attached together and weighted with a 160 gram weight, and the loop was allowed to remain in contact with the rotating mandrel for 15 seconds. The test length of the cleaning fabric was then removed from the mandrel and the area thereof which had contacted the rotating mandrel was folded over the edge of a 1 millimeter thick microscope slide, with the contact surface of the cleaning fabric disposed outwardly. The folded cleaning fabric was then held against a plate having parallel graduations spaced at 0.5 millimeter intervals, aligned with one of the graduations, the number of fibers crossing each graduation was counted in a 36 millimeter width of the folded wiping cloth, and the number of crossings were totaled.

For a series of such tests, an average of 2 crossings were found. This compares to an average of 29 crossings for a series of the same test on the aforementioned Pellon Grade 301W spun bonded polyamide web.

EXAMPLE 2

A cleaning fabric was prepared and tested in the manner described in Example 1, except that the rayon used in the wiping layer was 1½ denier instead of 3 denier. In the cleaning efficiency test this cleaning fabric left an average of about 3 particles per square centimeter, which was higher than the average number of particles left by the fabric of Example 1, but was deemed satisfactory. The fiber release test produced an average of about 3½ crossings for this cleaning fabric, which was higher than the average number of crossings produced on the cleaning fabric of Example 1, but was also deemed satisfactory.

EXAMPLE 3

A cleaning fabric was prepared and tested in the manner described in Example 1, except that the rayon used in the wiping layer was 5½ denier instead of 3 denier. In the cleaning efficiency test this cleaning fabric left an average of about 30 particles per square centimeter, which was much higher than the average number of particles left by the fabric of Example 1, and was deemed unsatisfactory. The fiber release test produced an average of about 8 crossings for this cleaning fabric, which was also significantly higher than the average number of crossings produced on the cleaning fabric of Example 1.

EXAMPLE 4

A cleaning fabric was prepared and tested in the manner described in Example 1, except that an amount of binder was used for laminating the wiping layer and backing layer together to produce a cleaning fabric with a 33% dried binder content by weight. In the cleaning efficiency test this cleaning fabric left an average of about 3 particles per square centimeter, which was higher than the average number of particles left by the fabric of Example 1, but was deemed satisfactory. The fiber release test produced an average of about 2 crossings for this cleaning fabric, which was the same as the average number of crossings produced on the cleaning fabric of Example 1.

EXAMPLE 5

A cleaning fabric was prepared and the fiber release test was performed in the manner described in Example 1, except that an amount of binder was used for laminating the wiping layer and the backing layer together to produce a cleaning fabric with about a 22% dried binder content by weight. The fiber release test produced an average of about 37 crossings for this cleaning fabric, which was much higher than the average number of crossings produced on the cleaning fabric of Example 1, and was deemed unacceptable.

EXAMPLE 6

A cleaning fabric was prepared and the fiber release test was performed in the manner described in Example 1, except that an amount of binder was used for laminating the wiping layer and the backing layer together to produce a cleaning fabric with about a 23% dried binder content by weight. The fiber release test produced an average of about 12 crossings for this cleaning fabric, which was higher than the average number of crossings produced on the cleaning fabric of Example 1, and was not deemed acceptable.

EXAMPLE 7

A cleaning fabric was prepared and the fiber release test was performed in the manner described in Example 1, except that an amount of binder was used for laminating the wiping layer and the backing layer together to produce a cleaning fabric with about a 25% dried binder content by weight. The fiber release test produced an average of about 6⅓ crossings for this cleaning fabric, which was higher than the average number of crossings produced on the cleaning fabric of Example 1, but was deemed acceptable.

EXAMPLE 8

A cleaning fabric was prepared and the fiber release test was performed in the manner described in Example 1, except that an amount of binder was used for laminating the wiping layer and the backing layer together to produce a cleaning fabric with about a 27% dried binder content by weight. The fiber release test produced an average of about 6½ crossings for this cleaning fabric, which was higher than the average number of crossings produced on the cleaning fabric of Example 1, but was deemed acceptable.

EXAMPLE 9

A cleaning fabric was prepared and the fiber release test was performed in the manner described in Example 1, except that an amount of binder was used for laminating the wiping layer and the backing layer together to produce a cleaning fabric with about a 40% dried binder content by weight. The fiber release test produced an average of about 2 crossings for this cleaning fabric, which was the same as the average number of crossings produced on the cleaning fabric of Example 1.

I claim:

1. In an apparatus for cleaning photographic film upon movement thereof along a path defined on said apparatus, which apparatus has cleaning means comprising a pair of adjacent support members defining opposed narrow, parallel support edges disposed transverse to said path; two lengths of cleaning fabric extending between said support edges, the opposed contact surfaces of the sections of cleaning fabric between said support edges defining part of said path, said support members being positioned to urge the opposed contact surfaces of said sections of cleaning fabric toward each other with essentially equal pressure distribution along said support edges during the passage of a said photographic film therebetween; the improvement wherein said lengths of cleaning fabric are laminates and each length of cleaning fabric comprises:

a non-woven wiping layer of soft fine intersecting bonded fibers defining said contact surface, the fibers in said wiping layer being randomly spaced and disposed to provide openings in the wiping layer for receiving said foreign particles, and the wiping layer being compacted in a direction normal to the contact surface so that few ends or loops of the fibers project past the contact surface; thereby restricting shearing or tearing loose of the fibers by a passing photographic film; an an open non-woven lofty backing layer adhered to the surface of said wiping layer opposite said contact surface, said backing layer comprising stiff resilient randomly spaced and disposed bonded fibers and being sufficiently thick to be supported in a partially compressed condition by said support members to evenly press said contact surface into intimate engagement with a said photographic film between said lengths of cleaning fabric and to maintain such contact by expanding or being further compressed to compensate for irregularities in the film.

2. An apparatus according to claim 1, wherein the fibers in said wiping layer are in the range of 1½ to 3 denier, and the fibers in said backing layer are at least 3 denier.

3. An apparatus according to claim 1, wherein the fibers in said wiping layer are hydrophilic.

4. An apparatus according to claim 1, wherein the thickness of said cleaning fabric is in the range of 0.2 to 0.5 millimeter and the compressibility of said fabric is at least 0.05 millimeter under a loading of about 183 grams per square centimeter.

5. An apparatus according to claim 2, wherein said cleaning fabric has a fiber weight of 8 pounds per ream of 3 denier rayon in the wiping layer and 5 pounds per ream of 3 denier polyester and 5 pounds per ream of 3 denier high modulus rayon in the backing layer, and comprises dried latex binder comprising over about 25% of the total cleaning fabric weight.

6. A cleaning fabric adapted for use in an apparatus for cleaning photographic film upon movement of the film along a path defined on said apparatus, which apparatus has cleaning means comprising a pair of adjacent support members defining opposed narrow parallel support edges disposed transverse to said path; two lengths of said cleaning fabric extending between said support edges, the opposed contact surfaces of the sections of cleaning fabric between said support edges defining part of said path, said support members being positioned to urge the opposed contact surfaces of said sections of cleaning fabric toward each other with essentially equal pressure distribution along said support edges during the passage of a said photographic film therebetween to remove foreign particles from both surfaces of the photographic film, said cleaning fabric being a laminate comprising:

a non-woven wiping layer of soft fine intersecting bonded fibers defining said contact surface, the fibers in said wiping layer being randomly spaced and disposed to provide openings in the wiping layer for receiving said foreign particles, and the wiping layer being compacted in a direction normal to the contact surface so that few ends or loops of the fibers project past the contact surface, thereby restricting shearing or tearing loose of the fibers by a passing photographic film; and an open non-woven lofty backing layer adhered to the surface of said wiping layer opposite said contact surface, said backing layer comprising stiff resilient randomly spaced and disposed bonded fibers and being sufficiently thick to be supported in a partially compressed condition by a said support member to evenly press said contact surface into intimate engagement with a said photographic film between said lengths of cleaning fabric and to maintain such contact by expanding or being further compressed to compensate for irregularities in the film.

7. A cleaning fabric according to claim 6, wherein the fibers in said wiping layer are in the range of 1½ to 3 denier, and the fibers in said backing layer are at least 3 denier.

8. A cleaning fabric according to claim 6, wherein the fibers in said wiping layer are hydrophilic.

9. A cleaning fabric according to claim 6, wherein the thickness of said cleaning fabric is in the range of 0.2 to 0.5 millimeter and the compressibility of said fabric is at least 0.5 millimeter under a loading of about 183 grams per square centimeter.

10. A cleaning fabric according to claim 7, wherein said cleaning fabric has a fiber weight of 8 pounds per ream of 3 denier rayon in the wiping layer and 5 pounds per ream of 3 denier polyester and 5 pounds per ream of 3 denier high modulus rayon in the backing layer, and comprises dried latex binder comprising over about 25% of the total cleaning fabric weight.

* * * * *

UNITED STATES PATENT AND TRADEMARK OFFICE

CERTIFICATE OF CORRECTION

PATENT NO. : 3,945,079

DATED : March 23, 1976

INVENTOR(S) : Walter M. Westberg

It is certified that error appears in the above-identified patent and that said Letters Patent are hereby corrected as shown below:

Col. 2, line 64, after "27" insert -- % --.

Col. 8, line 57, change "an" to -- and --.

Col. 10, line 30, change "0.5" to -- 0.05 --.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*